US006515246B2

(12) United States Patent
Brandsaeter

(10) Patent No.: US 6,515,246 B2
(45) Date of Patent: Feb. 4, 2003

(54) APPARATUS FOR SORTING PRODUCTS

(75) Inventor: Tore Brandsaeter, Konsberg (NO)

(73) Assignee: Buhrs Holding B.V., De Rotterdam (NL)

( * ) Notice: Subject to any disclaimer, the term of this patent is extended or adjusted under 35 U.S.C. 154(b) by 0 days.

(21) Appl. No.: 09/795,360

(22) Filed: Mar. 1, 2001

(65) Prior Publication Data

US 2001/0052485 A1 Dec. 20, 2001

(30) Foreign Application Priority Data

Mar. 1, 2000 (NO) ..... 1014532

(51) Int. Cl.[7] ..... B07C 5/00

(52) U.S. Cl. ..... 209/583; 209/630; 209/900; 209/917; 209/933

(58) Field of Search ..... 209/552, 559, 209/563, 564, 583, 629, 630, 900, 916, 918, 933, 937, 917

(56) References Cited

U.S. PATENT DOCUMENTS 5,101,983 A * 4/1992 Scata ..... 209/583
5,687,850 A * 11/1997 Speckhart et al. ..... 209/583 X
6,079,570 A * 6/2000 Oppliger et al. ..... 209/630

FOREIGN PATENT DOCUMENTS

EP A1578859 1/1994
EP A1879778 11/1998
GB 2224147 * 4/1990 ..... 209/583
WO A1-9632207 10/1996

* cited by examiner

*Primary Examiner*—Tuan N. Nguyen
(74) *Attorney, Agent, or Firm*—Birch, Stewart, Kolasch & Birch, LLP

(57) ABSTRACT

An apparatus for sorting products, such as magazines, newspapers and books, CDs and/or diskettes, includes a separation station arranged for making single items of the products supplied in stacks, a conveyor arranged for conveying one by one the products coming from the separation station, and a number of sorting stations arranged adjacent the conveyor. The sorting stations are connected to the conveyor such that a product located on the conveyor can be supplied from the conveyor to a desired sorting station for forming a sorted collection of products in the respective sorting station. The apparatus further includes a control. The control is arranged for controlling at least the conveyor and the sorting stations, such that at least two sorting functions can be performed. A first sorting function involves sorting an unordered collection of products according to type of product, which collection comes from a customer, such as a shopkeeper or a kiosk-keeper, whereby in a respective sorting station products of the same type are collected. A second sorting function involves assembling a number of customer orders.

10 Claims, 1 Drawing Sheet

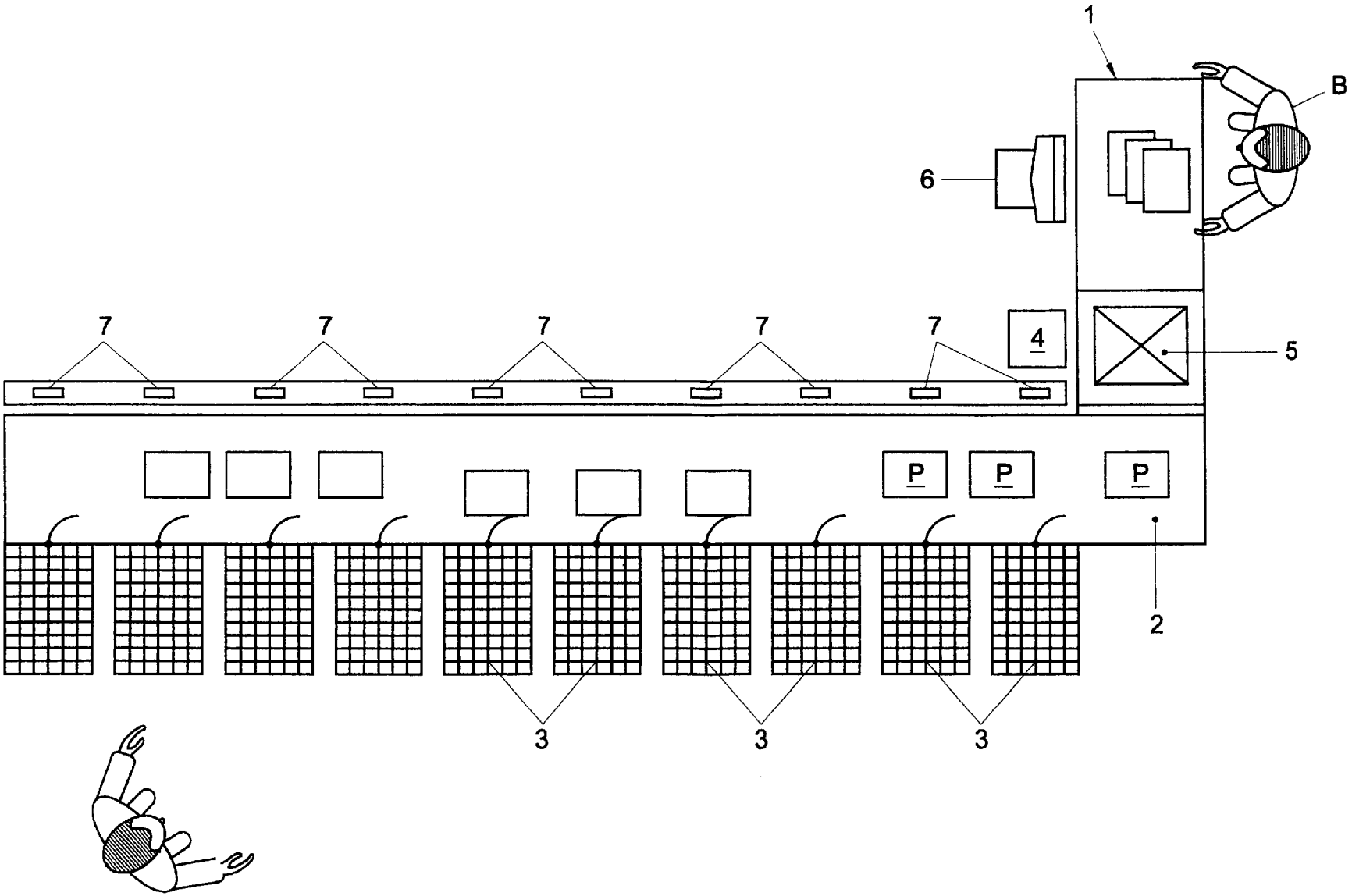
B
1
6
5
4
7
7
7
7
7
P
P
P
2
3
3
3

APPARATUS FOR SORTING PRODUCTS

BACKGROUND OF THE INVENTION

1. Field of the Invention

This invention relates to an apparatus for sorting products, such as newspapers, magazines, books, CDs and/or diskettes. The apparatus includes a separation station arranged for making single items of products supplied in stacks, a conveyor arranged for conveying one by one the products coming from the separation station, and a number of sorting stations arranged adjacent the conveyor. The sorting stations is connected to the conveyor such that a product located on the conveyor can be supplied from the conveyor to a desired sorting station for forming a sorted collection of products in the respective sorting station. The apparatus further includes a control.

2. Description of Background Art

Such an apparatus is known per se and is used specifically in newspaper and magazine distribution, for processing newspapers, magazines or products which a customer has not sold by the end of a selling period, such as, for instance, a day, a week or a month, and which this customer has returned unsorted to the publisher or wholesaler. The products returned in stacks are made into single items in the separation station, the type of each product is determined using detection means, and it is counted how many products of each type are being returned, this in connection with the crediting of the customer. Thereafter the products are, for instance, sent back to the publisher, destroyed, included in subscription portfolios with magazines, or sold to institutions at a reduced price. The customers settle with the publishers or wholesalers on the basis of the number of copies sold. It is then of importance, therefore, that the publisher or wholesaler determines accurately how many copies of each type of product are being returned by the customer. If desired, in connection with the further processing of the products, these products are sorted according to type with the aid of the conveyor and the sorting stations.

It is noted that a description of a separation station is given in EP 0 879 778, the contents of which are to be considered inserted herein.

In the distribution of newspapers, magazines, books, CDs and the like, publishers and wholesalers have a need for an apparatus which automatically assembles the orders of the various customers (sales outlets). In practice, for these operations, special apparatuses are being marketed. Apart from the considerable investments involved in the purchase of these apparatuses, these separate apparatuses also occupy space in the factory or hall of the publisher, wholesaler or distributor.

SUMMARY OF THE INVENTION

The invention is based on the insight that an apparatus for processing unsorted collections of products, such as, for instance, unsorted stacks of newspapers or magazines which are being returned by the shops and the kiosks to the publishers or wholesalers is essentially a sorting apparatus which, at least if it possessed the appropriate control, could also serve for assembling orders of customers.

The apparatus of the type described in the opening paragraph hereof is characterized, according to the invention, in that the control is arranged for controlling at least the conveyor and the sorting stations, such that at least two sorting functions can be performed.

As a result of these measures, with the same hardware, two functions can be performed, for which functions heretofore two apparatuses were needed. It will be clear that in this way the publisher or wholesaler not only saves a considerable investment but also gains a lot of space in his establishment. Moreover, the capacity of the apparatus for processing unsold, returned products is utilized much better. Thus, for instance, during the day, assembling the orders could be carried out on the apparatus, while during the night, using the same apparatus, the products returned by the customers can be sorted by type.

According to a further elaboration of the invention, the first sorting function involves sorting an unordered collection of products according to type of product, which collection comes from a customer, such as a shopkeeper or a kiosk-keeper, whereby in a respective sorting station products of the same type are collected.

According to a still further elaboration, the second sorting function concerns assembling a number of customer orders.

In particular for the purpose of the first sorting function, it is particularly favorable when the separation station comprises detection means arranged for making known to the control of what type each product supplied is, the control being arranged for subsequently causing the conveyor and/or the sorting station intended to collect that type of product to be so controlled that the respective product is delivered to the desired sorting station.

This prevents, for instance, a loader needing to input, in respect of each magazine or product, of what type that magazine or product is, since the detection means perform this task automatically.

According to a further elaboration of the invention, in respect of each unordered collection of products it is determined, and stored in the control, how many copies of each type of product the unordered collection contains. Owing to these data being stored, the eventual settlement with the customer is considerably simplified.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

The FIGURE is a top plan view of an exemplary embodiment of the present invention.

DETAILED DESCRIPTION OF THE PREFERRED EMBODIMENTS

The present invention will now be described with reference to the accompanying figure. The exemplary embodiment represented in top plan view is intended for sorting magazines P, newspapers or books, CDs or diskettes or combinations thereof. The apparatus comprises a separation station 1, a conveyor 2 and a number of sorting stations 3. The apparatus can include, for instance, a hundred sorting stations 3.

Provided adjacent each sorting station 3 are means with which a product P located on the conveyor 2 can be brought into the sorting station 3. These means can form part of the sorting station 3, for instance in the form of a pusher plate (not shown) which pushes a product P transversely to the conveyor 2 into the associated sorting station 3. The means can also form part of the conveyor 2, for instance in the form of a switch in the conveyor 2 adjacent each sorting station 3. Such a switch, in a first position, can allow further conveyance of the product P in the conveying direction of the conveyor 2, while in a second position it causes the product P to end up in the associated sorting station 3. The sorting station 3 can be, for instance, a basket, bin or cart in which the products supplied to the sorting station are collected.

The apparatus as described above is, as such, known for sorting returned products. Novelty and inventive step reside in the control 4 of the apparatus. In fact, the control is suitable for performing two sorting functions. The control 4 in the present exemplary embodiment operates the means with which the products P located on the conveyor 2 are brought into the sorting stations 3.

The first sorting function the control 4 can perform is directed to processing an unordered collection of magazines and sorting this unordered stack according to type of magazine. It is customary in the newspaper and magazine trade that customers, such as shops and kiosks, return newspapers and magazines which have not been sold after a certain period, to the publisher, wholesaler or distributor. The publisher, wholesaler or distributor settles with the customer, taking into account the number of magazines the customer has returned. For this purpose it is therefore of importance that the publisher, wholesaler or distributor determines accurately how many copies of each type of product the customer has bought and returned. Accordingly, in this first sorting function, the apparatus collects magazines P of the same type in a respective sorting station 3. These newspapers and magazines sorted by type can subsequently, for instance, be destroyed, be included in subscription portfolios with magazines, or be used for other applications.

In the second sorting function, collections of magazines P of the same type are supplied to the separation station 1. The apparatus is then used for assembling orders from customers, such as shops, kiosks and like sales outlets. In that case, each sorting station 3 is assigned to a customer. In the control 4 a list is stored which contains data about the number of copies of each type of product that each customer wishes to receive. A stack of magazines P of a particular type supplied to the separation station is distributed over the sorting stations 3 in accordance with the list stored in control 4. When all stacks of magazines P have been fed into the separation station 1 and have been processed by the apparatus, the sorting stations 3 assigned to a customer contain the number of copies of each type of product P the respective customer has ordered.

In the present exemplary embodiment, the separation station 1 comprises detection means 5 arranged for making known to the control 4 of what type a passing product P is. On the basis of the data observed by the detection means 5, the control 4 can cause the means with which a product P located on the conveyor 2 can be brought into a sorting station 3 to be so controlled that the respective detected product P is delivered to the desired sorting station 3.

Further, the separation station 1 comprises means known per se (not shown) for converting a stack of magazines P to single items, such that the products end up one by one on the conveyor 2. The separation station 1 further comprises a terminal 6 for the benefit of a loader B, who loads the separation station 1 manually with collections of products P. The terminal 6 in the present exemplary embodiment has an input facility, such as, for instance, a touch-screen or a keyboard, by means of which the loader can input the type of product so as to make this known to the control 4.

In the present exemplary embodiment, each sorting station 3 comprises a display 7. When the apparatus performs the first sorting function, it can, for instance, be indicated on the display 7 what type of product is collected in the sorting station 3 in question. When the apparatus performs the second sorting function, it can, for instance, be indicated on the display 7 which customer has been assigned to the sorting station 3 in question.

It will be clear that the invention is not limited to the exemplary embodiment described, but that various modifications are possible within the framework of the invention. Thus, the separation station 1 may be suitable, for instance, for the fully automatic processing of a stack of magazines or newspapers. It is also possible that the sorting stations 3, instead of being designed as sorting baskets or bins, are designed as conveyors carrying off the products being supplied on them for further processing.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for sorting products, the apparatus comprising:

a separation station, said separation station being arranged for separating products supplied in stacks into single products;

a conveyor, said conveyor being arranged for conveying the products from the separation station one by one; and a plurality of sorting stations, said plurality of sorting stations being arranged adjacent the conveyor and connected to the conveyor such that a product located on the conveyor can be supplied from the conveyor to a respective of said plurality of sorting stations for forming a sorted collection of products in the respective sorting station; and a control, said control being arranged for controlling at least the conveyor and the plurality of sorting stations, such that at least two sorting functions can be performed, wherein the first sorting function involves sorting an unordered collection of products according to a type of product, which comes from a customer, whereby products of the same type are collected in a respective sorting station, and the second sorting function involves assembling a number of customer orders, wherein the separation station comprises detection means arranged for informing the control of the type of each product being supplied, the control being arranged for subsequently causing the conveyor and/or the sorting station intended to collect the type of product to be controlled such that the respective product is delivered to the desired sorting station, wherein with regard to each unordered collection of products, the number of copies of each type of product in the unordered collection is determined and stored in the control, and wherein with regard to the second sorting function, the control assigns at least one sorting station to each customer, collections of products of the same type successively supplied to the separation station are distributed over the plurality of sorting stations, such that each customer receives the number of copies of each type of product desired by the customer.

2. The apparatus according to claim 1, wherein a memory is present in the control, said memory being loaded with a list, said list containing data for each customer regarding the number of copies of each type of product the respective customer wishes to receive, the control of the sorting stations and/or the conveyor being controlled by the control depending on said list.

3. The apparatus according to claim 1, wherein the separation station comprises means for converting a stack of products into single items such that the products end up on the conveyor one by one.

4. The apparatus according to claim 1, wherein the separation station comprises a terminal for the benefit of a loader who loads the separation station manually with collections of products, the terminal comprising an input facility by means of which the loader can input the type of product to inform the control.

5. The apparatus according to claim 1, wherein each of said plurality of sorting stations comprises a display on which, if the first sorting function is performed, it is indicated what type of product is collected in the respective sorting station, and on which, if the second sorting function is performed, it is indicated which customer has been assigned to the respective sorting station.

6. The apparatus according to claim 1, wherein the products are magazines, newspapers and books, CDs and/or diskettes.

7. The apparatus according to claim 1, wherein the customer is a shopkeeper or a kiosk.

8. The apparatus according to claim 1, wherein the same plurality of sorting stations are used to perform said at least two sorting functions.

9. The apparatus according to claim 1, wherein the same conveyor is used to perform said at least two sorting functions.

10. The apparatus according to claim 1, wherein said conveyor and each of said plurality of sorting stations are used to perform said at least two sorting functions.

* * * * *